United States Patent [19]

Tagawa

[11] Patent Number: 4,955,961

[45] Date of Patent: Sep. 11, 1990

[54] WORKING MACHINE

[75] Inventor: Itsuo Tagawa, Tokyo, Japan

[73] Assignee: Tagawakougyou Co. Ltd., Tokyo, Japan

[21] Appl. No.: 369,967

[22] Filed: Jun. 22, 1989

[51] Int. Cl.[5] ..... B02C 1/02

[52] U.S. Cl. ..... 241/264; 241/101.7; 269/61

[58] Field of Search ..... 269/61, 34, 71; 901/25, 901/26; 241/101.2, 101.7, 264–269

[56] References Cited

U.S. PATENT DOCUMENTS 1,736,363 11/1929 Ramsden ..... 269/34 X
3,682,327 8/1972 Winne ..... 901/25 X

FOREIGN PATENT DOCUMENTS 3613484 10/1987 Fed. Rep. of Germany ..... 269/71
150570 9/1981 German Democratic Rep. ... 901/25
6695 8/1957 Japan .

*Primary Examiner*—Mark Rosenbaum

*Attorney, Agent, or Firm*—Lowe, Price, LeBlanc, Becker & Shur

[57] ABSTRACT

A working machine comprises a machine body provided with a pair of arms which are arranged for movement toward and away from each other. The machine body is disposed for rotation, relative to a bracket mounted on the machine body, about an axis. A hydraulic cylinder assembly has a single cylinder defining therein a hydraulic chamber, and a single piston mounted to a piston rod extending through the hydraulic chamber, the piston rod having opposite ends thereof, which extend respectively from opposite ends of the hydraulic chamber, and which are fixedly connected to the bracket. Upon introduction of hydraulic fluid into the hydraulic chamber, the cylinder and a rack fixedly mounted to the outside of the cylinder are moved in the direction perpendicular to the axis, so as to cause a pinion meshing with the rack and the machine body connected with the pinion to rotate about the axis, thereby changing the direction of the plane in which the arms mounted on the machine body are moved.

5 Claims, 3 Drawing Sheets

WORKING MACHINE

FIELD OF THE INVENTION

The present invention relates to a working machine having a pair of arms, such as a concrete breaker for use in destruction of a concrete structure, a cutter for cutting reinforcements, pipes or the like, or a gripper for gripping reinforcements, steel frames or the like.

BACKGROUND OF THE PRIOR ART

Conventionally known is a working machine of a type having a machine body and a pair of arms mounted thereon, e.g., a stationary arm and a movable arm which is arranged for movement toward and away from the stationary arm. In order to positively clamp or crush an article to be gripped or crushed under the opening/closing motion of these arms, preferably, the direction along which the opening/closing motion plane of the arms extends must be changed in accordance with the posture of the article. For instance, when a beam or the like extending horizontally is crushed, the opening/closing plane of the arms is required to extend vertically. On the other hand, when a pillar or the like extending vertically is crushed, the plane of the arms is required to extend horizontally. For this purpose, a working machine of a type capable of changing the direction of the opening/closing plane of the arms, has already been developed as disclosed in, for example, Japanese Utility Model Publication No. Sho 57-6695.

However a further improvement is still desired in a mechanism for rotating the machine body of the working machine.

SUMMARY OF THE INVENTION

It is therefore an object of the present invention to provide a working machine which is capable of rotating a machine body so as to variably set the direction of a plane in which a pair of arms are opened/closed relatively to each other.

According to a preferred embodiment of the present invention, there is provided a working machine, which comprises: a machine body; a pair of arms mounted on the machine body for movement toward and away from each other in a plane; a bracket mounted on the machine body, the machine body being arranged for rotation relative to the bracket about an axis; a hydraulic cylinder assembly having a single cylinder defining therein a hydraulic chamber, and a single piston mounted to a piston rod extending through the hydraulic chamber to thereby divide the hydraulic chamber into two chambers, the piston rod unit having opposite ends thereof which extend respectively from opposite ends of the hydraulic chamber, the opposite ends of the piston rod unit being fixedly connected to the bracket; a rack fixedly mounted to the outside of the single cylinder of the hydraulic cylinder assembly; and a pinion mounted on the machine body and in mesh with the rack for rotation relative thereto about the axis, whereby the cylinder of the hydraulic cylinder assembly and the rack are moved relatively to the bracket in a direction perpendicular to the axis upon introduction of hydraulic fluid into the hydraulic chamber, so that the pinion and the machine body are rotated about the axis with the movement of the rack.

The present invention is advantageous in that the direction of the plane in which the pair of arms are moved can be altered by the hydraulic cylinder assembly. Thus, it is possible to efficiently carry out various operations of the working machine such as crushing, cutting, clamping and transporting operations. In particular, since the direction of the arm motion plane can be changed in dependence on an amount of the hydraulic fluid introduced into the hydraulic chamber, it is possible to set the plane direction at any angle.

DETAILED DESCRIPTION OF THE PREFERRED EMBODIMENTS

Figure 1:
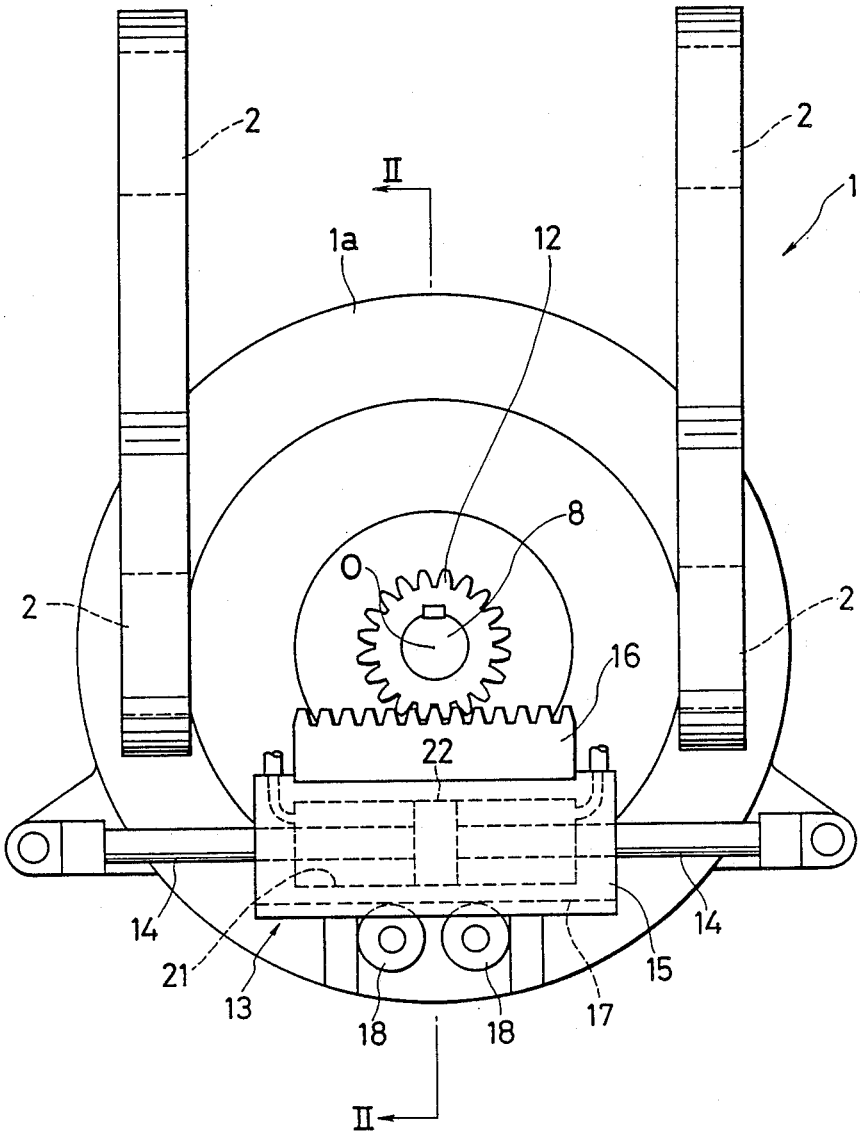
FIG. 1 is a front elevational view of a working machine according to a preferred embodiment of the invention.
Figure 2:
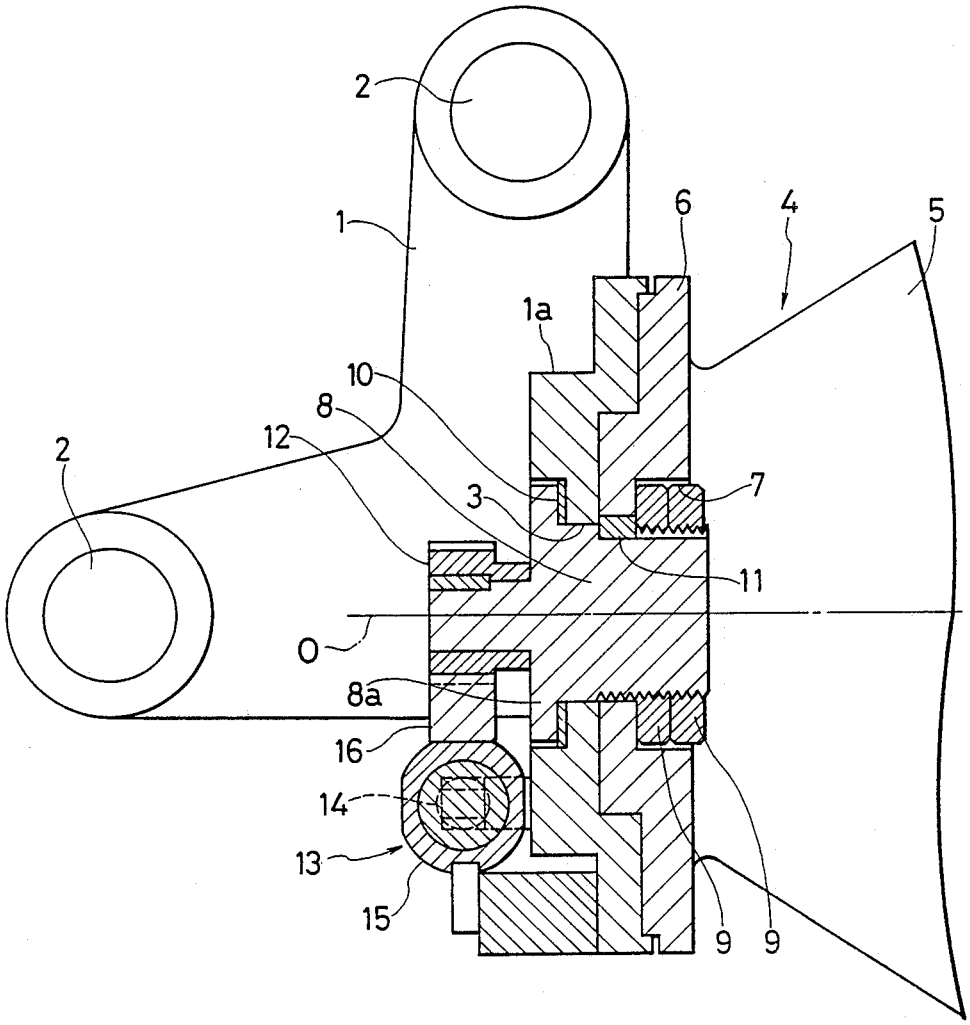
FIG. 2 is a cross-sectional view taken along the line II—II in FIG. 1.
Figure 3:
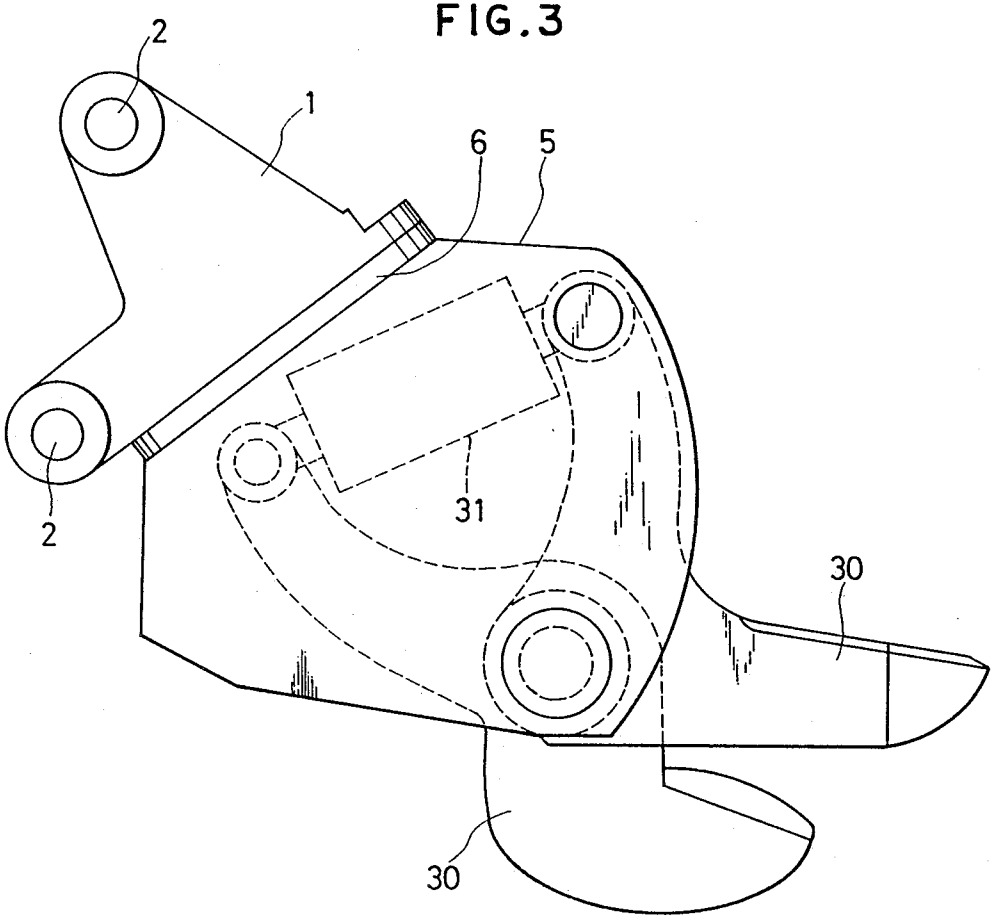
FIG. 3 is a side view showing a pair of arms mounted on side plates of FIG. 1.

FIGS. 1–3 show a working machine according to an embodiment of the invention. The working machine comprises a bracket 1 which is mounted to a forward end of an arm of a hydraulic shovel (not shown) or the like through a plurality of pins (not shown) inserted respectively into attaching bores 2. The bracket 1 has a main body 1*a* which is formed at its center with a bore 3.

As shown in FIG. 2, the working machine comprises a machine body 4 which has an end plate 6. Fixed to the end plate 6 are a pair of side plates (one of which is shown by reference numeral 5) between which a pair of arms, i.e., a stationary arm 30S and a movable arm 30M are mounted. These arms 30S and 30M are arranged to be driven relative to one another by a hydraulic cylinder assembly 31 or the like so as to move toward and away from each other in a plane whose direction is variabley set in a manner mentioned below. The end plate 6 is formed at its center with a bore 7 in alignment with the bore 3 of the bracket body 1*a*. The bracket body 1*a* and the end plate 6 are clamped between a flange 8*a* of a rotary shaft 8 extending through the bores 3, 7 and two nuts 9 threadedly engaged with the rotary shaft 8. The bracket body 1*a* and the flange 8*a* of the rotary shaft 8 are disposed in contact with each other through a washer 10 so that these elements are rotatable relatively to each other about an axis O. Further, the end plate 6 of the machine body 4 is fixedly connected to the rotary shaft 8 through a key 11 for rotation in unison therewith. A pinion 12 is fixedly mounted to an end of the rotary shaft 8 at the side remote from the machine body 4.

As shown in FIG. 1, a hydraulic cylinder assembly 13 of double rod type is operatively coupled to the bracket body 1*a*. The hydraulic cylinder assembly 13 has a single cylinder 15 which defines therein a hydraulic chamber 21. A single piston 22 is accommodated in the hydraulic chamber 21 to divide the same into a pair of chamber sections. A piston rod 14 is fixedly mounted to the piston 22 and extends through the hydraulic chamber 21 such that opposite ends of the piston rod 14 extend respectively from opposite ends of the hydraulic chamber 21. The opposite ends of the piston rod 14 are fixedly connected to the bracket body 1*a*. A linear rack 16 is fixedly mounted to the outside of the single cylinder 15 of the hydraulic cylinder assembly 13, and is in mesh with the aforesaid pinion 12. A pair of guide rollers 18 are mounted rotatably on the bracket body 1*a* and are in rolling contact 1 preferably with a guide groove 17 formed in the cylinder 15 for guiding the cylinder 15. The guide rollers 18 are located at a position on the opposite side of the cylinder 15 from the rack 16.

The operation of the working machine constructed as above will now be described.

When hydraulic fluid is introduced into one of the pair of chamber sections of the hydraulic chamber 21, since the opposite ends of the piston rod unit 14 are fixedly connected to the bracket body 1*a*, the cylinder 15 is selectively moved to the right or left as viewed in FIG. 1. As a result, the rack 16 fixedly mounted on the cylinder 15 and in mesh with the pinion 12 is moved to the right or left as viewed in FIG. 1, to rotate the pinion 12 about the axis O. The rotational movement of the pinion 12 causes the rotary shaft 8, fixedly connected to the pinion 12, to rotate relatively to the bracket 1 through the washer 10. The rotational movement of the rotary shaft 8 is transmitted to the end plate 6 of the machine body 4, which is fixedly connected to the rotary shaft 8 through the key 11. Thus, the end plate 6 is caused to rotate about the axis O so that the machine body 4 rotates relatively to the bracket 1. In this manner, it is possible to change the extending direction of the plane in which the opening/closing relative motion of the pair of arms 30 is effected.

Here, the length of the rack 16 and the moving distance of the cylinder 15 of the hydraulic cylinder assembly 13 are set to values enough to permit the pinion 12 to rotate through about 180 degrees, so that the machine body 4 is enabled to rotate about the axis O relatively to the bracket 1 through about 180 degrees. This makes it possible to claim and crush the article to be gripped or crushed by the pair of arms 30, even in the article is disposed in any angular posture.

Further, the pair of guide rollers 18 are engaged with the guide groove 17 which is located on the opposite side of the cylinder 15 from the position where the rack 16 and the pinion 12 are in mesh with each other. Accordingly, it is possible to prevent the cylinder 15 and the piston rod unit 14 from being deformed, and to prevent the rack 16 and the pinion 12 from being disengaged from each other. Thus, the alteration of the direction along which the opening/closing motion plane of the arms 30 extends can be achieved without trouble. Moreover, by changing an amount of the hydraulic fluid introduced into one of the pair of chamber sections of the hydraulic chamber 21, it is possible to arbitrarily set and determine the operating position of the cylinder 15. Thus, the angular position of the machine body 4, that is, the direction along which the opening/closing motion plane of the arms 30 extends can be determined optionally, to thereby attain an enhanced efficiency of the destruction operation of a structure.

Furthermore, since the machine body 4 is rotated by the use of the hydraulic cylinder assembly 13, a large rotary torque can be generated. Further, it is possible, for example, to rotate the machine body 4 about the axis O under a condition that the beam or pillar to be crushed are lightly clamped between the pair of arms 30, so as to accurately locate the arms 30 at their desired positions wherein the opening/closing motion plane of these arms extends perpendicularly to the beam or pillar.

Further, since the hydraulic cylinder assembly 13 is mounted horizontally on the bracket 1, the height of the working machine can be reduced, as compared with the conventional one.

In this disclosure, there are shown and described only the preferred embodiments of the invention, but, as aforementioned, it is to be understood that the invention is capable of use in various other combinations and environments and is capable of changes or modifications within the scope of the inventive concept as expressed herein.

What is claimed is:

1. A working machine, comprising:

a machine body;

a pair of arms mounted on said machine body for relative movement toward and away from each other in a plane that is variably oriented;

a bracket mounted on said machine body, said machine body being arranged for rotation relative to said bracket about as axis;

a hydraulic cylinder assembly having a single cylinder defining therein a hydraulic chamber, and a piston rod unit comprising a piston rod extending through said hydraulic chamber and a single piston fixedly mounted to said piston rod so as to divide the hydraulic chamber into a pair of chamber sections, said piston rod having opposite ends thereof which extend respectively from opposite ends of said hydraulic chamber, said opposite ends of said piston rod being fixedly connected to said bracket;

a rack fixedly mounted to said cylinder of said hydraulic cylinder assembly; and a pinion mounted on said machine body and in mesh with said rack for rotation relative thereto about said axis, whereby said cylinder of said hydraulic cylinder assembly and said rack are moved relatively to said bracket in a direction perpendicular to said axis upon introduction of hydraulic fluid into said hydraulic chamber, so that said pinion and said machine body are rotated about said axis with the movement of said rack.

2. A working machine according to claim 1, further comprising:

roller means rotatably mounted on said bracket for guiding said cylinder.

3. A working machine according to claim 2, wherein:

said roller means includes a pair of guide rollers mounted on said bracket at a location on the opposite side of said cylinder from said rack.

4. A working machine according to claim 3, wherein:

said cylinder of said hydraulic cylinder assembly has a guide groove with which said pair of guide rollers are in contact.

5. A working machine according to claim 1, wherein:

said machine body includes a rotary shaft, said pinion being fixedly mounted to said rotary shaft.

* * * * *